US010888146B2

(12) United States Patent
Corsi et al.

(10) Patent No.: US 10,888,146 B2
(45) Date of Patent: Jan. 12, 2021

(54) APPARATUS FOR HOLDING AND DISPENSING COSMETICS

(71) Applicants: Stephen Corsi, Los Angeles, CA (US); Jacky Gunter, Westlake Village, CA (US)

(72) Inventors: Stephen Corsi, Los Angeles, CA (US); Jacky Gunter, Westlake Village, CA (US)

(73) Assignee: The Roberts Container Corporation, Chatsworth, CA (US)

( * ) Notice: Subject to any disclaimer, the term of this patent is extended or adjusted under 35 U.S.C. 154(b) by 0 days.

(21) Appl. No.: 16/358,686

(22) Filed: Mar. 19, 2019

(65) Prior Publication Data

US 2019/0216202 A1 Jul. 18, 2019

Related U.S. Application Data

(63) Continuation-in-part of application No. 15/257,911, filed on Sep. 7, 2016, now Pat. No. 10,231,528.

(60) Provisional application No. 62/215,026, filed on Sep. 6, 2015.

(51) Int. Cl.

| | |
|---|---|
| ***A45D 40/02*** | (2006.01) |
| ***A45D 40/12*** | (2006.01) |
| ***A45D 40/24*** | (2006.01) |

(52) U.S. Cl.
CPC ..... *A45D 40/02* (2013.01); *A45D 40/12* (2013.01); *A45D 40/24* (2013.01)

(58) Field of Classification Search
CPC ..... A45D 40/02; A45D 40/12; A45D 40/24; A45D 40/00; A45D 2040/00; A45D 2040/0025; A45D 2040/205; A45D 2040/207; B05C 17/01; B05C 17/0116
See application file for complete search history.

(56) References Cited

U.S. PATENT DOCUMENTS

| | | | | |
|---|---|---|---|---|
| 2,071,747 A * | 2/1937 | Houlihan | ..... | A45D 40/02 401/83 |
| 3,902,814 A * | 9/1975 | Cardia | ..... | A45D 40/02 401/83 |
| 5,984,553 A * | 11/1999 | Piscopo | ..... | A45D 40/02 401/82 |
| 8,066,443 B2 * | 11/2011 | Thiebaut | ..... | A45D 40/02 401/82 |

* cited by examiner

*Primary Examiner* — David J Walczak
(74) *Attorney, Agent, or Firm* — Law Office of David Hong

(57) ABSTRACT

There is a container that allows the movement of a cosmetic product in a holder within a sheath from a first position to a second position with the force translated from a button slider outside the sheath to underneath the product holder; the button slider engages a wave shaped channel on the sheath structure, which provides a smooth amount of resistance to maintain the product at a desired position but said amount of resistance can be easily overcome by the user.

10 Claims, 4 Drawing Sheets

DETAIL A
Scale 1:2

DETAIL B
Scale 1:2

DETAIL C
Scale 1:2

SECTION A-A

APPARATUS FOR HOLDING AND DISPENSING COSMETICS

PRIORITY CLAIM

This application is a continuation in part of U.S. patent application Ser. No. 15/257,911, filed on Sep. 7, 2016 and issued as U.S. patent Ser. No. 10/231,528 on Mar. 19, 2019, which claimed the benefit of U.S. Provisional Patent Appl. No. 62/215,026, filed Sep. 6, 2015, which are all incorporated by reference in entirety.

BACKGROUND OF THE INVENTION

1. Field of the Invention

This invention relates to dispensers and containers for cosmetics, pharmaceuticals, food or other consumable matter.

2. Description of Related Art

Prior to the present invention, there has always been a need to have containers to hold cosmetics, foundation and make-up (solid, powder and liquid form) in an easy to carry, organize and open/close manner.

Prior devices used too much material within the apparatus to move the material from a first elevation to a second elevation; wasted material is unacceptable when the cosmetic, pharmaceutical or other consumable matter is expensive, valuable or small in size or quantity. Other prior art devices like a stick of deodorant or lip balm require unused space within the apparatus for the base and screw lifting apparatus; this adds to a larger product.

With the enclosed invention, less material or matter is needed within the product holder or base; this invention provides volume savings of nearly thirty percent of material needed to be used with the apparatus or product holder. Further, this invention allows for a much smaller and compact container for cosmetics, pharmaceutical or other consumable products.

This invention also provides the ability for using different cross-sectional shapes of the bullet (round, oval, square, rectangular or non-uniform); this invention also allows for the linking of two apparatus for holding cosmetics, pharmaceutical or other consumable products.

From the preceding descriptions, it is apparent that the devices currently being used have significant disadvantages. Thus, important aspects of the technology used in the field of invention remain amenable to useful refinement.

SUMMARY OF THE INVENTION

There is one preferred embodiment of the invention, which is presented as an apparatus for holding a cosmetics matter, which comprises: a product holder with a first product holder end for holding the cosmetics matter and a second product holder end; the product holder can lie and fit slidably within a sheath; the sheath can have a channel that runs along a longitudinal axis of the sheath; a button slider slidably engages the sheath; the channel of the sheath can have a waved channel surface, which has a waved surface with a first channel surface elevation and a second channel surface elevation; wherein the button slider allows a consumer to apply a force along the longitudinal axis of the sheath; the force is translated from the button slider to the product holder along the longitudinal axis of the sheath so that the product holder can be moved from a first product elevation to a second product elevation; the button slider can have at least one boss portion, which engages the waved channel surface; this boss portion can be triangular or any abstract or uniform shape.

This invention allows for a much smaller and compact container and using different cross-sectional shapes of the bullet for cosmetics, pharmaceutical or other consumable products. The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

PARTS LISTING

Figure 2:
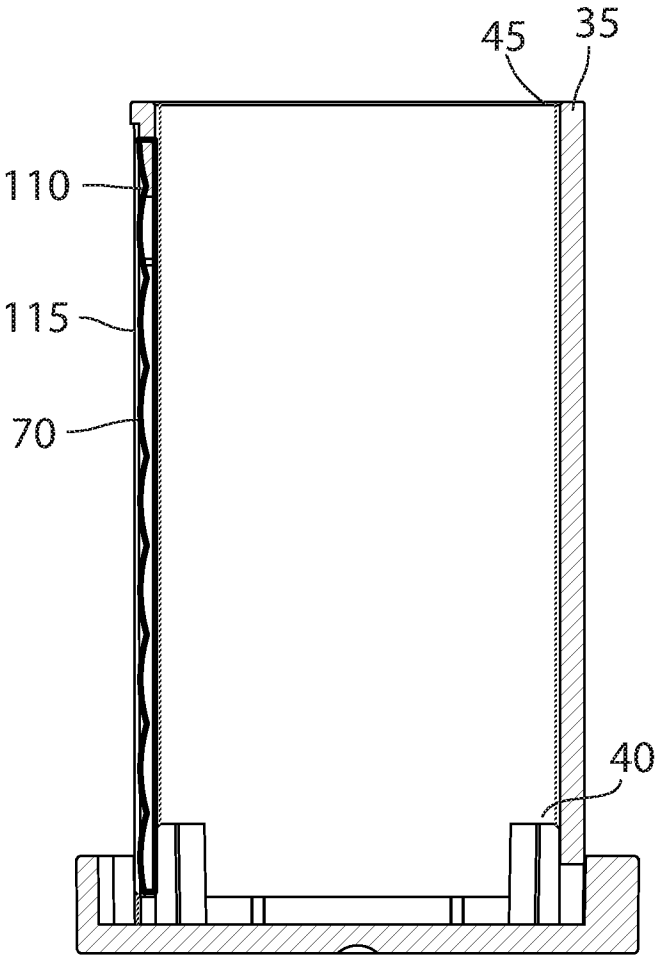
FIG. 2 is a partial cross-sectional view of FIG. 1; the waved channel surface is in bolded lines.
Figure 1:
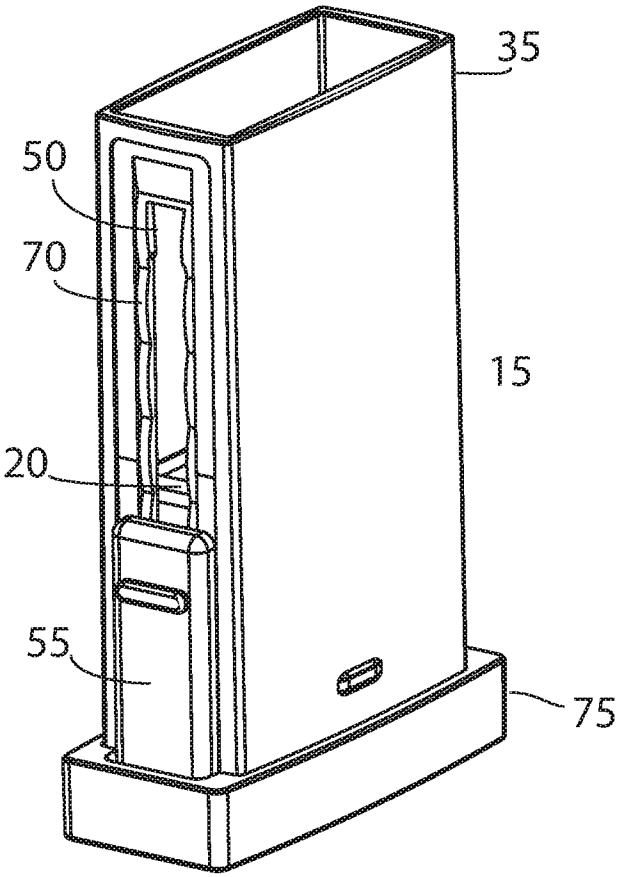
FIG. 1 shows one perspective view of one preferred embodiment of an apparatus for holding and dispensing cosmetics matter.

15 apparatus for holding a cosmetics material
20 product holder
25 first product holder end for holding the cosmetics matter and
30 second product holder end;
35 sheath;
40, 45 open sheath ends;
50 channel that runs along a longitudinal axis of the sheath;
55 button slider slidably engages the sheath;
60 first button slider end
65 second button slider end
70 waved surface on channel
75 base engages the sheath.
80 flexible prong on the second button slider end, which engages the channel on the sheath.
85, 86 triangular boss portions
90 rib on the inside surface of the product holder
95 arm of the sliding button
100 engagement area on the product holder
105 loop of the engagement area of the product holder
110 $1^{st}$ elevation or thickness on the wave surface of the channel on the sheath

115 $2^{nd}$ elevation or thickness on the wave surface of the channel on the sheath

DESCRIPTION OF THE PREFERRED EMBODIMENTS

FIGS. 1-11 show a preferred embodiment of an apparatus for holding cosmetics, pharmaceutical or consumable matter (hereinafter "matter"). This apparatus has a product holder or cup, which engages a button slider and a sheath; the apparatus is enclosed within a cap and a base or base connector (FIG. 1 in U.S. Ser. No. 15/257,911); a connector can attach two or more apparatus containers together.

Product Holder, Sheath and Button Slider:

As shown in FIG. 1-11, there is an apparatus for holding a cosmetics matter, which comprises: a product holder with a first product holder end for holding the cosmetics matter and a second product holder end; the product holder can lie and fit slidably within a sheath; the sheath can have a channel that runs along a longitudinal axis of the sheath; a button slider slidably engages the sheath; the button slider can have a first button slider end and a second button slider end; the first button slider end and the second button slider end can lie perpendicularly with respect to one another; the second button slider end can be perpendicular to the longitudinal axis of the sheath; the second button slider end can engage the product holder; the first button slider end can slidably engage the sheath; the channel of the sheath can have a channel surface, which has a waved surface with a first channel surface elevation and a second channel surface elevation; wherein the button slider allows a consumer to apply a force along the longitudinal axis of the sheath; the force is translated from the first button slider end to the second button slider end and to the product holder along the longitudinal axis of the sheath so that the product holder can be moved from a first product elevation to a second product elevation.

The button slider can have at least one boss portion, which engages the waved channel surface; this boss portion can be triangular or any abstract or uniform shape, including without limitation: circular or nubbed; the boss portions can be on the first button slider end and also on the central portion of the button slider. The first button slider end can have at least one flexible prong, which can engage the channel on the sheath; the product holder can have at least one rib.

Product Holder, Sheath and Button Slider:

The product holder has a first end for holding the matter and a second end for engaging a button slider. The product holder lies and fits slidably within a sheath; the sheath is hollow and can mimic the shape of the product holder, but is preferably longer to be able to hold the cosmetic material; the sheath has open ends.

Figure 7A:
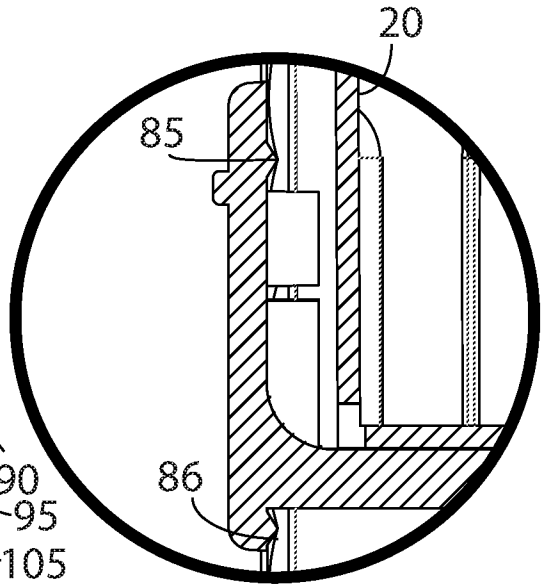
FIG. 7A is a close-up or expanded view of FIG. 7, which shows the triangular boss portions engaging the wave surface of the channel on the sheath.
Figure 7:
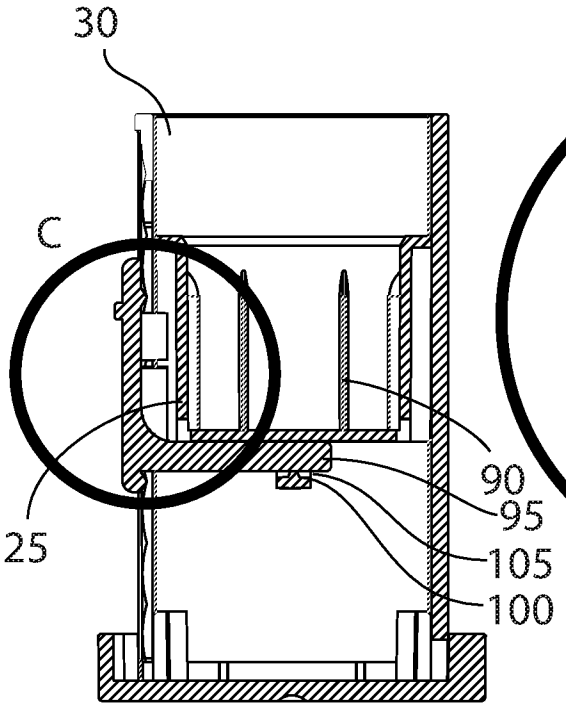
FIG. 7 is a cross-sectional view along the Sec. Lines A-A in FIG. 5.
Figure 6:
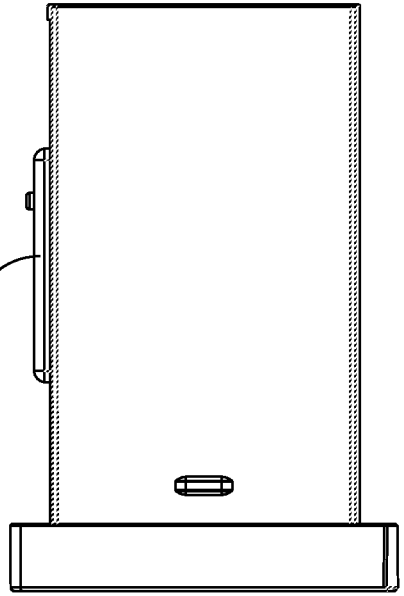
FIG. 6 is another plan view of the apparatus, thereof; the opposite side is an opposite view, thereof.
Figure 5:
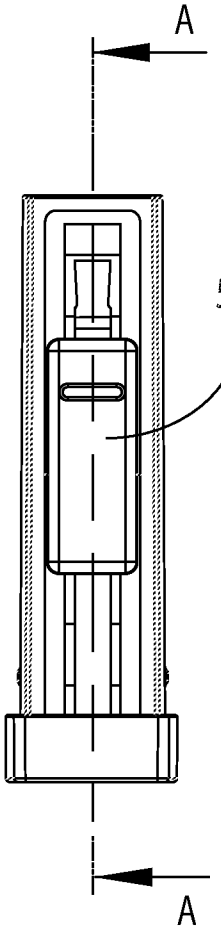
FIG. 5 is a plan view of the button slider engaging the channel of the sheath.
Figure 11:
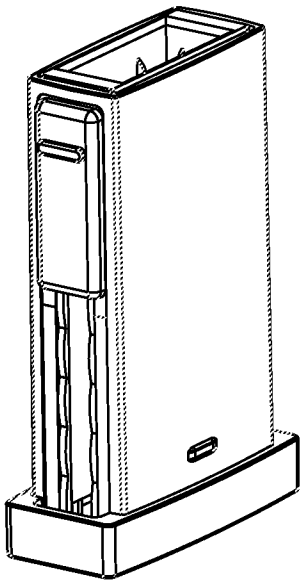
FIGS. 9, 10 and 11 show the progression of the button slider up the sheath and along the waved surface of the channel of the sheath.
Figure 10:
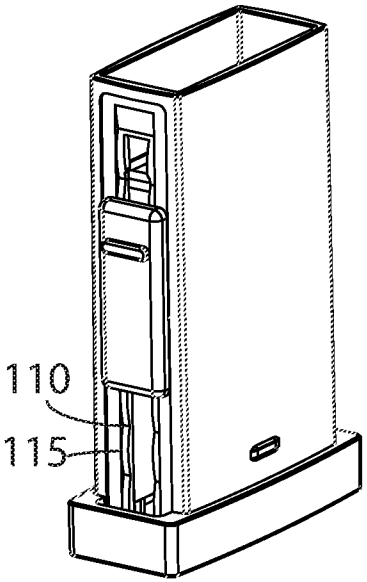

As shown in FIG. 7, the second end of the product holder engages the button slider; this second end of the product holder can have an engagement area, loop, groove, slot or shelf, wherein the button slider can connect and engage; this engagement area on the second end of the product area can mimics the shape of the portion of the arm or the button slider end; this can be described as a male/female connection.

The button slider can have a first button slider end and a second button slider end; the first and the second button slider ends lie perpendicular with respect to one another; the second end of the button slider is also perpendicular to the longitudinal axis of the sheath. The button slider allows the user to apply a force along the longitudinal axis of the sheath; this force is translated to the second end of the button slider to either lift or to lower the product holder with respect to the sheath.

The second end of the button slider can have a length that extends substantially, partially or the entire length of the product holder to help provide enough surface area of contact to apply a consistent force to the product holder when the user or the consumer applies an upward or downward force to the first end of the button slider. The L-shape of the button slider apparatus is important (but not intended to be limiting) because it applies force to the center of the product holder.

Channel and Wave Surface:

The button slider engages one end of the sheath that can have a slot, a channel or a groove to allow for a measured or controlled movement of the product holder up and down the length of the sheath. In a preferred embodiment, the sheath has an inside sheath surface, which provides varying resistance to movement of the sliding button at a first sheath location and at a second sheath location. In another embodiment, the channel on the sheath channel can have at least one or multiple waved surface portions.

Figure 4B:
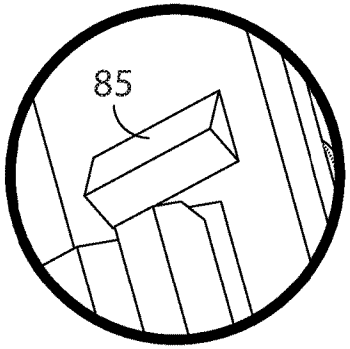
FIG. 4A and FIG. 4B are close-up views from FIG. 4, which shows the triangular-shaped boss structures on the button slider.
Figure 4A:
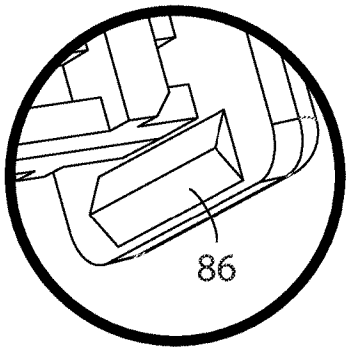
Figure 4:
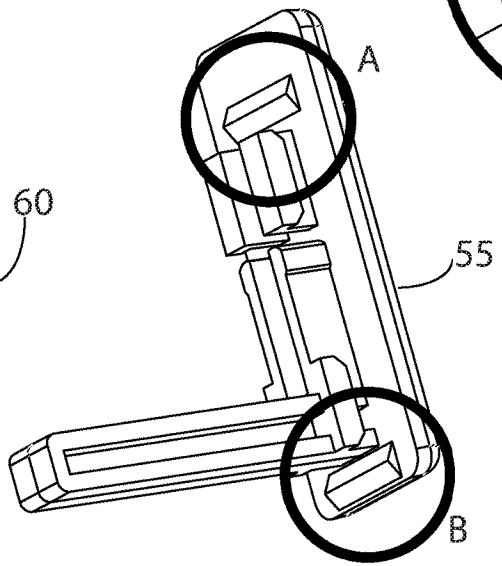
FIGS. 3 and 4 are perspective views of the button slider.
Figure 3:
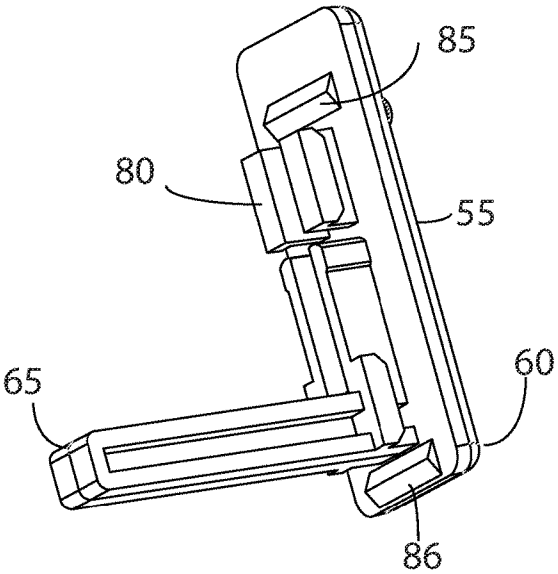

This waved surface provides enough resistance to maintain the button slider (with the product holder) at a certain elevation or height on the sheath, but at the same time, allow for the user to apply pressure to the button slider to overcome the initial resistance from the waved surface. FIG. 4 shows the boss structures as being triangular in shape, but this is not intended to be limiting, but just one preferred embodiment; other uniform or varied shapes can be used.

Figure 9:
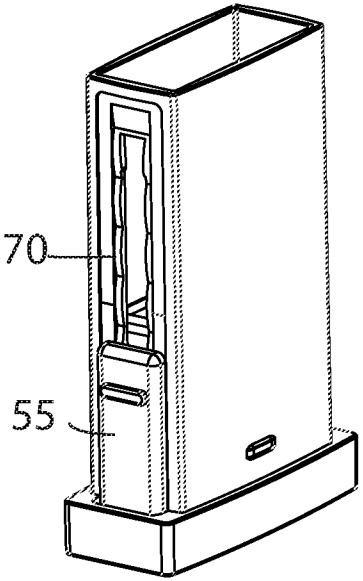
Figure 8:
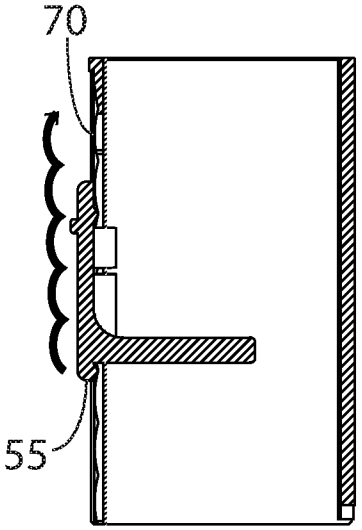
FIG. 8 is another partial cross-sectional view of the button slider engaging the waved surface of the sheath.

As shown in FIGS. 8 and 9 of the related U.S. patent application Ser. No. 15/257,911, other embodiments allow two products to be connected so that a consumer can have different types or colors of cosmetics within one easy to use product. This apparatus and mechanism for advancing the matter or product could be used with a variety of cup and sheath shapes, including square, triangle or even round shapes.

Other embodiments include an apparatus for holding a cosmetics matter comprising: a product holder, which holds the cosmetics matter; the product holder fits slidably within a sheath; the sheath has a channel that runs along a longitudinal axis of the sheath; a button slider slidably engages the sheath; the button slider has a first button slider end and a second button slider end; the second button slider end is perpendicular to the longitudinal axis of the sheath; the second button slider end engages the product holder; the first button slider end slidably engages the sheath; the channel of the sheath has a waved channel surface with a first channel surface elevation or thickness and a second channel surface elevation or thickness; the first thickness can be smaller than the second thickness; wherein the button slider allows a consumer to apply a force along the longitudinal axis of the sheath; the force is translated from the first button slider end to the second button slider end and to the product holder along the longitudinal axis of the sheath so that the product holder can be moved from a first product elevation to a second product elevation.

Another proposed preferred embodiment of the invention is presented in a package for dispensing a cosmetic product comprising: a product holder with a first open product holder end and a second closed product holder end; the second closed product holder end having a centrally disposed engagement area and a length; a sheath with a channel; a sliding button, which slidably engages the sheath along the channel; the sliding button having an arm that contacts and supports the length of the second closed product holder end;

the arm of the sliding button connects to the centrally disposed engagement area on the second closed product holder end; the channel of the sheath has a waved channel surface with a first channel surface elevation and a second channel surface elevation; whereby when a user applies a force to the sliding button, the force is translated to the second closed product holder end and allows the product holder to move from a first product elevation to a second product elevation. The centrally disposed engagement area is a loop, and the arm of the sliding button fits within the loop.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the title, headings, terms and phrases used herein are not intended to limit the subject matter or scope; but rather, to provide an understandable description of the invention. The invention is composed of several sub-parts that serve a portion of the total functionality of the invention independently and contribute to system level functionality when combined with other parts of the invention.

The terms "a" or "an" are defined as "one" or "more than one." The term "plurality" is defined as two or more than two. The term "another" is defined as at least a second or more. The terms "including" and/or "having" are defined as "comprising" (i.e., open language). The term "coupled" is defined as "connected," although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

INCORPORATION BY REFERENCE

All publications, patents, and patent applications mentioned in this specification are herein incorporated by reference to the same extent as if each individual publication, patent, or patent application was specifically and individually indicated to be incorporated by reference: Thiebaut (U.S. Pat. No. 8,066,443); Visser (U.S. Pat. No. 6,464,418); U.S. Pat. No. 6,060,041 CANDAU; U.S. Pat. No. 6,391,233 Otani; US Patent Publ. No. 2003/0216483 Hermann.

We claim:

1. An apparatus for holding a cosmetics matter comprising:
- a product holder for holding the cosmetics matter;
- the product holder lies and fits slidably within a sheath;
  - the sheath has a channel that runs along a longitudinal axis of the sheath;
- a button slider slidably engages the sheath;
  - the button slider has a first button slider end and a second button slider end;
  - the first button slider end and the second button slider end lie perpendicularly with respect to one another;
  - the second button slider end is perpendicular to the longitudinal axis of the sheath;
- the second button slider end engages the product holder;
- the first button slider end slidably engages the sheath;
- the channel of the sheath has a waved channel surface, with a first channel surface elevation and a second channel surface elevation;
- the button slider has at least one triangular boss portion, which engages the waved channel surface;
- wherein the button slider allows a consumer to apply a force along the longitudinal axis of the sheath; the force is translated from the first button slider end to the second button slider end and to the product holder along the longitudinal axis of the sheath so that the product holder can be moved from a first product elevation to a second product elevation.

2. The apparatus of claim 1, wherein the first button slider end has at least one flexible prong, which engages the channel on the sheath.

3. The apparatus of claim 1, wherein the product holder has at least one rib.

4. An apparatus for holding cosmetics matter comprising:
- a product holder, for holding the cosmetics matter;
- the product holder fits slidably within a sheath;
  - the sheath has a channel that runs along a longitudinal axis of the sheath;
- a button slider slidably engages the sheath;
  - the button slider has a first button slider end and a second button slider end;
  - the second button slider end is perpendicular to the longitudinal axis of the sheath;
- the second button slider end engages the product holder;
- the first button slider end slidably engages the sheath;
- the channel of the sheath has a waved channel surface with a first channel surface elevation and a second channel surface elevation;
- wherein the button slider allows a consumer to apply a force along the longitudinal axis of the sheath; the force is translated from the first button slider end to the second button slider end and to the product holder along the longitudinal axis of the sheath so that the product holder can be moved from a first product elevation to a second product elevation.

5. The apparatus of claim 4, wherein the first button slider end has at least one flexible prong, which engages the channel on the sheath.

6. The apparatus of claim 4, wherein the button slider has at least one boss portion, which engages the waved channel surface.

7. A package for dispensing a cosmetic product comprising:
- a product holder with a first open product holder end and a second closed product holder end;
  - the second closed product holder end having a centrally disposed engagement area and a length;
- a sheath with a channel;
- a sliding button, which slidably engages the sheath along the channel;
  - the sliding button having an arm that contacts and supports the length of the second closed product holder end;
  - the arm of the sliding button connects to the centrally disposed engagement area on the second closed product holder end;
  - the channel of the sheath has a waved channel surface with a first channel surface elevation and a second channel surface elevation;
  - whereby when a user applies a force to the sliding button, the force is translated to the second closed product holder end and allows the product holder to move from a first product elevation to a second product elevation.

8. The package of claim 7, wherein the centrally disposed engagement area is a loop, and the arm of the sliding button fits within the loop.

9. The package of claim 7, wherein the button slider has at least one boss portion, which engages the waved channel surface.

10. The package of claim 9, wherein the at last one boss portion is triangular in shape.

* * * * *